United States Patent [19]

Wendel

[11] 4,187,701

[45] Feb. 12, 1980

[54] LAUNDRY HOT WATER SUPPLY SYSTEM AND APPARATUS

[75] Inventor: Ion L. Wendel, St. Petersburg, Fla.

[73] Assignee: WenLo Corporation, St. Petersburg, Fla.

[21] Appl. No.: 660,323

[22] Filed: Feb. 23, 1976

[51] Int. Cl.[2] ..... D06F 31/00; D06F 39/04; D06F 58/00

[52] U.S. Cl. ..... 68/20; 34/90; 68/27; 122/248; 122/448 B; 134/107

[58] Field of Search ..... 68/20, 27, 207, 3 R, 68/13 R, 19; 34/86, 90, 19, 35; 122/20 A, 20 B, 420, 432, 247, 248, 448 B; 134/105, 107, 108

[56] References Cited

U.S. PATENT DOCUMENTS

| | | | |
|---|---|---|---|
| 1,860,495 | 5/1932 | Doerner | 122/420 |
| 2,143,874 | 1/1939 | Hagenson et al. | 122/20 A |
| 2,564,798 | 8/1951 | Allensworth | 34/86 X |
| 3,771,238 | 11/1973 | Vaughn | 68/20 X |
| 3,793,992 | 2/1974 | Marquez | 122/20 B |

*Primary Examiner*—Philip R. Coe
*Attorney, Agent, or Firm*—William E. Mouzavires

[57] ABSTRACT

A laundry dryer source of heat for providing warm gas to dry laundry is utilized to heat water for laundry washers use, and is particularly suited for coin operated laundries. In the illustrated embodiment each dryer has a gas burner and a water coil is in the flame area of the burner, the coils being connected in circuit between a cool water outlet and a heated water inlet of a typical automatic water heater tank. A pump circulates cool water from the tank through coils and returns heated water from the coils to the tank whenever any of the dryers are in operation. Since most laundry is promptly placed in a dryer after washing, during high or low capacity operation of the laundry, the quantity of heated water is automatically regulated by dryer operation to the overall demand for hot water by the washers, the automatic water heater tank providing heated water during sudden surges in washer operation before the dryers are in operation sufficiently to supply the hot water.

12 Claims, 3 Drawing Figures

LAUNDRY HOT WATER SUPPLY SYSTEM AND APPARATUS

This invention relates to laundry hot water supply and, more particularly, to a system and apparatus for providing heated water for washers by utilizing a dryer heat source.

BACKGROUND OF THE INVENTION

During low or normal capacity washer usage the automatic water heater provides adequate hot water for the washers in a laundry, but upon continuous heavy usage of the washers the water heater may prove to be inadequate and as a result the washers will be provided with lukewarm if not cold water. In typical coin operated laundries, one dryer is usually provided for two washers, with about ninety-five percent of the washed laundry generally being dried in the dryers. A system for preheating water for the automatic water heater is shown in a recently issued patent, U.S. Pat. No. 3,771,238, in which a portion of the cold water normally supplied to the water heater is preheated by passing it through coils exposed to the warm vent gases recirculated through the dryer. However, since the vent gas temperature is relatively low, this patented system can do no more than preheat water for the automatic water heater, it cannot heat the water to normal water supply temperatures. Additionally, this system is controlled responsive to water temperature in the automatic water heater rather than responsive to operation of one or more of the dryers. Among the references cited in the previous noted patent is U.S. Pat. No. 3,050,867, which is quite similar but uses water heating coils in the individual vent flues of the dryers, and this system is controlled responsive to flue gas temperature rather than to the temperature of water in an automatic water heater as in the other patent. Another citation in the first noted patent is U.S. Pat No. 1,731,290, which uses waste heat of a laundry environment for heating water. Other patents include U.S. Pat. No. 3,173,767, directed to a steam heated clothes dryer, and shows steam coils in an upper portion of the dryer for warming drying air which is circulated through the remainder of the dryer. U.S. Pat. No. 2,564,798 has separate compartments for washing, sterilizing, and drying dishes, and has burners for heating water coils, the exhaust of the burners being passed through a large conduit over which drying air is heated.

SUMMARY OF THE INVENTION

The invention, in brief, is directed to a laundry hot water supply system and apparatus in which a coil unit carrying water to be heated is positioned proximate a laundry dryer heater which warms laundry drying gas circulated to the drying chamber of the dryer for drying the laundry. The coil unit is positioned in the combustion area and, more particularly in the flame area of a combustion type burner which is usually an integral part of the dryer. In the illustrated embodiment of a coin operated laundry having a number of dryers, cool water from the usual automatic water heater which provides hot water for washers, is passed through the coil unit of any dryer in operation, the resultant heated water being returned to the water heater sufficiently hot for use by the washers particularly during peak periods of laundry operation when the supply of hot water may otherwise become inadequate. The apparatus and system is particularly suited for use in coin operated laundries since, in a practical sense, the number of drying periods for a given load of wet laundry is the same with or without use of the subject water heating system and apparatus.

It is an object of this invention to provide a new and useful laundry hot water supply system and apparatus.

A further object is provision of a new and useful laundry hot water supply system which provides hot water in proportion to laundry usage.

Still another object is provision of new and useful laundry hot water supply system and apparatus which may be easily and economically installed in existing laundries.

A more specific object is provision of a laundry hot water supply system including a laundry dryer having a chamber for receiving laundry to be dried with a source of warm gas delivered to the chamber for drying the laundry therein, the source including a heater for heating the gas responsive to operation of the dryer, and a water handling system including a water holding container, such as a coil, intimately associated with the heater upstream of the chamber relative to the flow of warm gas from the heater to the chamber, for heating the water by means of the heat generated by the heater, with a receiver for the heated water from the coil and, more particularly, the heater having sufficient capacity for heating the water to a normal temperature for washing and simultaneously heating the warm gas to a normal temperature for drying the laundry. A related object is provision for circulating cool water from a receiver to the coil and heated water from the coil back to the receiver, with a pump responsive to dryer operation for circulating the water therebetween. A further related object is provision of the dryer heater in the form of a combustion type burner which provides a combustion area and, more particularly, a flame area during normal operation, and the coil being positioned in the flame area of the burner. Still another related object is provision of such a system in a coin operated laundry having a plurality of coin operated washers and dryers and wherein the overall quantity of water heated by the dryers is generally proportional to the overall use of hot water by the washers.

Another more specific object is provision of new and useful laundry hot water supply apparatus in which a water holder such as a coil is positioned proximate a heater for laundry gas supplied to a drying chamber, the coil being intimately associated with the heater upstream of the chamber relative to the flow of warm gas from the heater to the chamber, the heat generated by the heater also heating the water. A related object is provision of such apparatus in which the heater is a combustion type burner which provides a combustion area and, more particularly, a flame area during normal dryer operation, and the coil is positioned in the flame area of the heater.

These and other objects and advantages of the invention will be apparent from the following description and the accompanying drawing.

DESCRIPTION OF THE ILLUSTRATED EMBODIMENT

Figure 1:
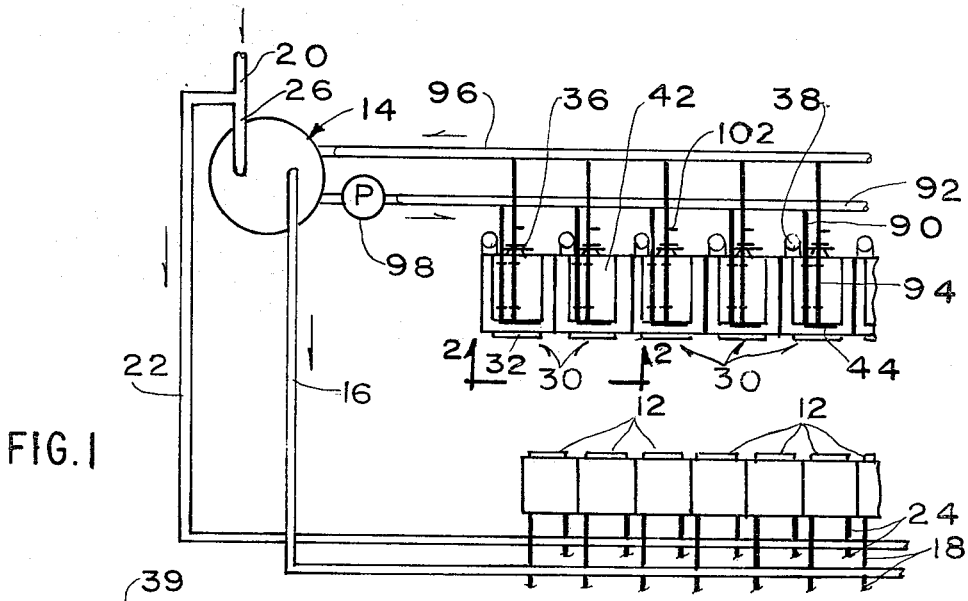
FIG. 1 is a schematic, fragmentary plan view of a portion of a coin operated laundry.

FIG. 1 of the drawing schematically illustrates a portion of a typical coin operated laundry having a plurality of coin operated washers 12 which receive hot water from an automatic water heater 14, including a storage tank, by means of a hot water supply pipe 16 connected through branch pipes 18 with the washers 12. The washers 12 are provided with cold water from a main supply pipe 20 through a cold water supply pipe 22 connected by branches 24 with the washers 12. The main supply pipe 20 also supplies the water heater 14 with cold water through pipe 26.

Figure 2:
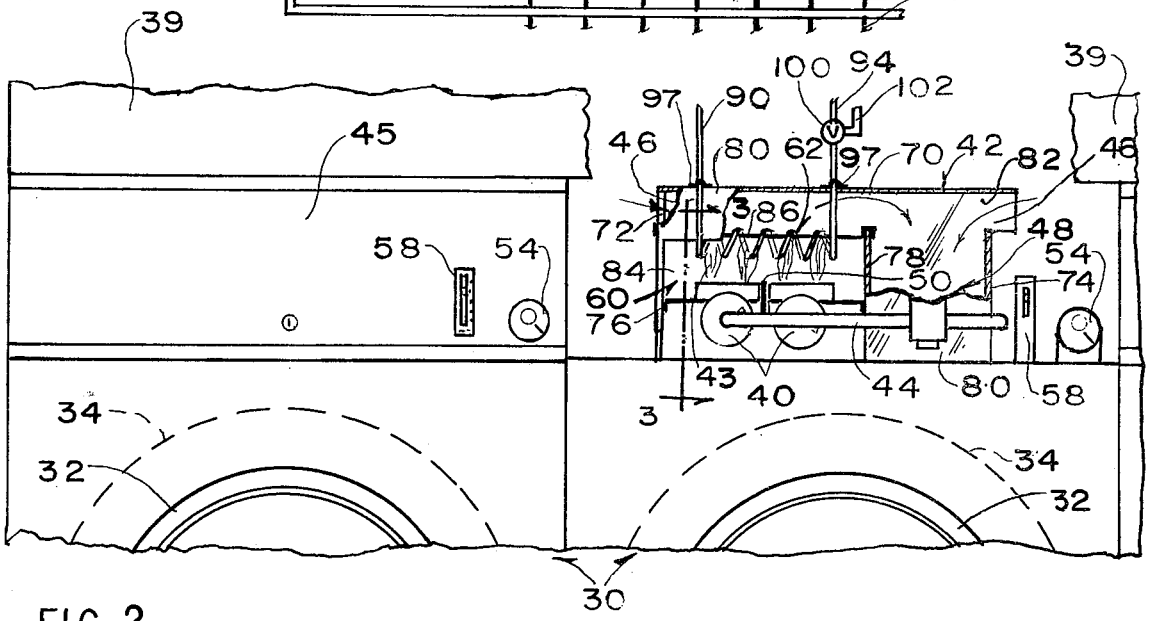
FIG. 2 is an enlarged, fragmentary schematic elevational view of laundry dryers, as indicated generally by the line 2—2 in FIG. 1, with a top panel of one of the dryers removed to show the heating portion of the dryer, and with parts broken away and removed for clearer illustration.

With continuing reference to FIG. 1, a plurality of typical laundry dryers 30, such as a Huebsch dryer, Model 37A, each have the usual door 32 for insertion and removal of laundry from a perforated cylinder 34 or chamber (dashed lines, FIG. 2). During drying operation the cylinder 34 is rotated in typical manner by a suitable electric motor and drive assembly 36 on the rear of the dryer and this assembly also operates an exhaust blower (not shown) in the bottom portion of the dryer to exhaust the drying gas through a suitable vent or flue 38, the vents usually being connected with an exhaust duct (not shown).

Figure 3:
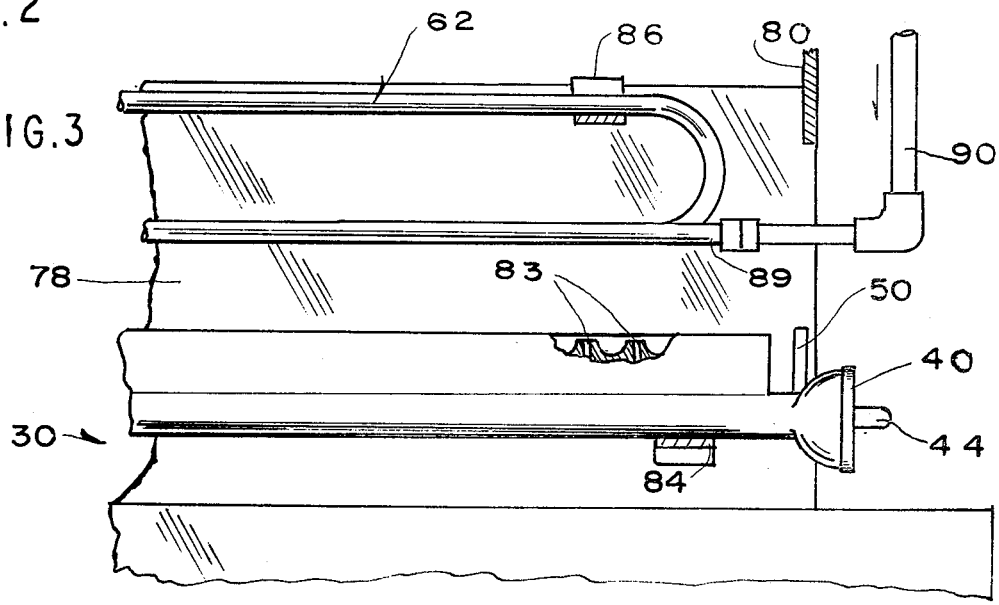
FIG. 3 is an enlarged, fragmentary, schematic, sectional elevational view taken generally along the line 3—3 in FIG. 2, with parts broken away and removed for clearer illustration.

With reference to FIGS. 2 and 3, a partition 39 is usually provided atop the front of the row of dryers 30 to conceal the piping, as 90–96. The upper portion of each dryer is provided with a heater, usually of the combustion type, such as a gas burner unit 40 within a casing 42. Each burner unit 40 provides a combustion area 43, including a flame area, of relatively intense heat. Each burner unit 40 has the usual burner supply line and controls 44, and is concealed by a removable panel 45. The casing 42 provides opposed inlets 46 for air which mixes with the hot gases developed by the burner flames, the resultant warm gas passing downwardly through a duct 48 (FIG. 2) opening toward the laundry chamber 34.

With continuing reference to FIG. 2, a coin meter 54, upon insertion of a coin and turning of an actuator knob, initiates operation of a timer to provide a predetermined period of drying for each coin inserted and causes the motor drive assembly 36 to be turned on and gas to be provided through the supply line 44 to the burner unit 40 which is ignited by a pilot light 50 between the burners. The dryer 30 also has a temperature selection lever 58.

As illustrated in FIGS. 2 and 3, the hot water supply system comprises water heating apparatus 60 including the burner unit 40 and a water holder such as a coil 62 positioned immediately above the burner unit 40 in the flame area thereof and well upstream of the cylinder 34 relative to the flow of warm gas from the burner unit 40 through the duct 48.

The casing 42 includes a top wall 70 connected by suitable supports 72 with opposite side walls 74 and 76, with the air inlets 46 between each side wall and the top wall 70. The side wall 74, along with a center wall 78, define sides of the duct 48, and a front wall 80 and a rear wall 82 of the casing 42 provide front and rear closures of the duct 48.

Burner unit 40 is supported by cross members 84 secured to the side wall 76 and the center wall 78, and the coil 62 is supported by cross members 86 receiving upper tube runs of the coil and having inverted U-shaped ends seated on the top edges of the side wall 76 and the center wall 78. The bottom tube runs of the coil 62 are preferably about two inches above the burner gas orfices 83, and the front of the coil 62 is spaced rearwardly of the pilot 50 so that the water in the coil is not heated by the pilot flame, thus avoiding the possibility of the water being heated when it is not circulating through the coils. In a Huebsch Model 37A dryer, approximately eighteen feet of copper tubing of one-half or three-quarter inch inside diameter is formed into five convolutions with the coil being approximately sixteen inches long, nine inches wide, and approximately two and one-half inches high so that it may be installed through the burner access opening in the front wall 80 of the casing 42.

As may be noted best in FIGS. 2 and 3, the front of each coil 62 has an inlet 89 (FIG. 3) and an outlet (not visable), the inlet connected with a cool water branch pipe 90 from a cool water supply pipe 92 (FIG. 1) and the outlet connected with heater water branch pipe 94 to a heated water return pipe 96 (FIG. 1). Branch pipes 90 and 94 may be seated on the casing top 70 to receive heat from the top and may be secured to the top by pipe straps 97 (FIG. 2). The pipes 92 and 96 are preferably connected into the bottom portion of the storage tank of the automatic water heater 14, and a motor driven pump 98 is provided in the cool water supply pipe 92 to circulate the water and is operated by a suitable control system (not shown) when any of the dryers 30 are turned on by insertion of a coin and operation of the actuator knob of the coinmeter 54. Pressure relief valves 100 (FIG. 2) are preferably provided in each of the heated water branches 94 and preferably open into the drain lines 102.

In the previously mentioned commercial dryer, each gas burner unit 40 develops approximately 142,000 BTU per hour and will develop heated water to a temperature of at least 130° F. With cool water in the bottom of an 80 gallon tank of water heater 14 at 60° F. and with only one dryer 30 in the system, and the heater of the automatic water heater 14 off, in three minutes the water temperature in the heated water return pipe 96 rose to 68° F., after thirty minutes of operation to 138° F. and after forty minutes of operation to 142° F., with no hot water being withdrawn through the hot water supply pipe 16. Thus, by positioning the coil 62 closely proximate the burner units 40, water may be heated to adequate temperature for washing purposes. Any suitable flow rate of the pump 98 may be provided to keep the water circulating during dryer operation.

Since most coin operated laundries have two washers 12 for each dryer 30, during extended peak periods the hot water supply system of this invention assures a continual supply of hot water to the washers, and in the event of a sudden peak load, rather than the normal gradual peaking, the hot water heater 14 is usually able to supply adequate hot water until the laundry loads are transferred from the washers to the dryers, whereupon the dryers provide ample hot water for continued laundry operations.

While this invention has been described and illustrated with reference to a particular embodiment in a particular environment, various changes may be apparent to one skilled in the art and the invention is therefore not to be limited to such embodiment or environment, except as set forth in the appended claims.

What is claimed is:

1. In a laundry dryer for use in association with a clothes washer and wherein the dryer includes a laundry chamber for receiving laundry to be dried, a heating unit for heating gas to be delivered to said laundry chamber to dry laundry therein, said heating unit including a casing and heating means in said casing for heating gas to be delivered to said laundry chamber, said heating means including a gas burner having gas orifices; the improvement comprising water handling means including a water conduit positioned in said casing adjacent said gas orifices of the burner for heating water in the conduit for use in a clothes washing operation simultaneously with the heating of gas to be delivered to said laundry chamber, said water conduit including a coil having a plurality of upper runs and a plurality of lower runs lying in generally parallel planes with the upper runs being interconnected to the lower runs and all of the runs are located within the heating chamber to the associated heating unit.

2. The improvement as defined in claim 1 wherein said coil is formed from copper tubing having an inside diameter of approximately one-half to three-quarters of an inch.

3. The improvement defined in claim 2 utilized in a laundry dryer wherein the heating means has a capacity capable of developing 142,000 btu per hour and wherein, the total length of the coil including the upper and lower runs thereof is approximately eighteen feet.

4. The improvement as defined in claim 1 wherein said coil has an inlet and an outlet, and wherein said water handling means further includes a cool water supply conduit, a branch conduit interconnecting the cool water supply conduit and the inlet of the coil, a hot water return conduit, and a branch conduit interconnecting the hot water return conduit and the outlet of the coil.

5. The improvement as defined in claim 4 wherein said water handling means includes a pump for circulating water from the cool water supply conduit through the coil and through the hot water return conduit.

6. The improvement as defined in claim 1 wherein said water conduit is located adjacent said gas orifices of the burner and wherein said heating means further includes a pilot and wherein said water conduit is spaced from the pilot.

7. The improvement as defined in claim 6 wherein the lower runs said water conduit is spaced approximately two inches from the orifices of said burner.

8. In a laundry washing and drying system including water supply means for supplying water for washing laundry, a plurality of dryers for drying washed laundry, each dryer including a laundry drying chamber for drying laundry therein and a heating unit including means defining a heating chamber and heating means in said heating chamber for heating gas to be delivered to the laundry drying chamber; the improvement comprising a plurality of water heating conduits respectively located in the heating chambers of each heating unit in association with the heating means for heating water conveyed through the water heating conduits, a water delivery system including a cool water header conduit connected to the water supply means and a hot water header conduit connected to said water supply means, said water heating conduits in the heating units having inlets connected to said cool water header conduit at locations spaced along the cool water header conduit, said water heating conduits in the heater units having outlets connected to said hot water header conduit at locations spaced along the hot water header conduit, and wherein said heating means have sufficient heating capacity for heating water in said water heating conduits to a normal temperature for washing laundry and simultaneously heating a sufficient quantity for warm gas for delivery to said laundry chamber for drying laundry.

9. The improvement defined in claim 8 wherein the water delivery system includes pump means in one of said header conduits operable in response to operation of a heating unit for driving water through the water delivery system including the water heating conduits in said heating units.

10. The improvement defined in claim 9 wherein the water delivery system includes pressure relief valve means associated with each of the water heating conduits for relieving pressure thereon.

11. The improvement defined in claim 10 wherein each water heating conduit includes a coil having a plurality of upper and a plurality of lower runs lying in generally parallel planes with the upper runs being connected to the lower runs and with all of the runs located within the heating chamber of the associated heating unit.

12. The improvement in a water system as defined in claim 11, wherein each of the heating means of the clothes dryers has a capacity such that it is capable of developing 142,000 btu per hour and wherein each of the coils is formed from highly conductive metallic tubing having an inside diameter of approximately one-half to three-quarters of an inch.

* * * * *